US009394126B2

(12) United States Patent
Sakamoto

(10) Patent No.: US 9,394,126 B2
(45) Date of Patent: Jul. 19, 2016

(54) PAPER FEEDING DEVICE, IMAGE FORMING APPARATUS, AND IMAGE READING DEVICE

(71) Applicant: FUJI XEROX CO., LTD., Tokyo (JP)

(72) Inventor: Toyohide Sakamoto, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/528,082

(22) Filed: Oct. 30, 2014

(65) Prior Publication Data

US 2015/0314975 A1 Nov. 5, 2015

(30) Foreign Application Priority Data

May 1, 2014 (JP) ..... 2014-094366

(51) Int. Cl.

| | |
|---|---|
| ***B65H 3/52*** | (2006.01) |
| ***B65H 3/06*** | (2006.01) |
| ***B65H 1/08*** | (2006.01) |
| ***B65H 5/06*** | (2006.01) |
| ***B65H 7/20*** | (2006.01) |

(52) U.S. Cl.

CPC ..... *B65H 3/5223* (2013.01); *B65H 1/08* (2013.01); *B65H 3/0638* (2013.01); *B65H 3/0669* (2013.01); *B65H 3/0676* (2013.01); *B65H 3/0684* (2013.01); *B65H 3/5261* (2013.01); *B65H 5/06* (2013.01); *B65H 7/20* (2013.01); *B65H 2402/31* (2013.01); *B65H 2402/32* (2013.01); *B65H 2404/694* (2013.01)

(58) Field of Classification Search

CPC ..... B65H 3/52; B65H 3/5223; B65H 3/5238; B65H 3/5261; B65H 3/5284

See application file for complete search history.

(56) References Cited

U.S. PATENT DOCUMENTS

2010/0156033 A1* 6/2010 Lee ..... B65H 3/5223 271/121

FOREIGN PATENT DOCUMENTS

| | | | | |
|---|---|---|---|---|
| JP | 10212044 | A | * | 8/1998 |
| JP | 2000-219347 | A | | 8/2000 |
| JP | 2002-087616 | A | | 3/2002 |
| JP | 2007076899 | A | * | 3/2007 |
| JP | 2011236042 | A | * | 11/2011 |

* cited by examiner

*Primary Examiner* — Luis A Gonzalez
(74) *Attorney, Agent, or Firm* — Oliff PLC

(57) ABSTRACT

Provided is a paper feeding device including a transporting unit that feeds one sheet away from sheets, a detaching member that detaches the one sheet away from the sheets together with the transporting unit, a supporting member that supports the detaching member, and that includes a shaft longer than the detaching member in a direction perpendicular to a sheet feeding direction, and a holding member that holds the shaft not to move to a downstream side in the sheet feeding direction, and that releases the shaft from holding when the shaft moves in a direction other than the sheet feeding direction.

18 Claims, 8 Drawing Sheets

PAPER FEEDING DEVICE, IMAGE FORMING APPARATUS, AND IMAGE READING DEVICE

CROSS-REFERENCE TO RELATED APPLICATIONS

This application is based on and claims priority under 35 USC 119 from Japanese Patent Application No. 2014-094366 filed May 1, 2014.

BACKGROUND

Technical Field

The invention relates to a paper feeding device, an image forming apparatus, and an image reading device.

SUMMARY

According to an aspect of the invention, there is provided a paper feeding device including:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction; and a holding member that holds the shaft not to move to a downstream side in the sheet feeding direction, and that releases the shaft from holding when the shaft moves in a direction other than the sheet feeding direction.

BRIEF DESCRIPTION OF THE DRAWINGS

Exemplary embodiments of the present invention will be described in detail based on the following figures, wherein.

DETAILED DESCRIPTION

Figure 1:
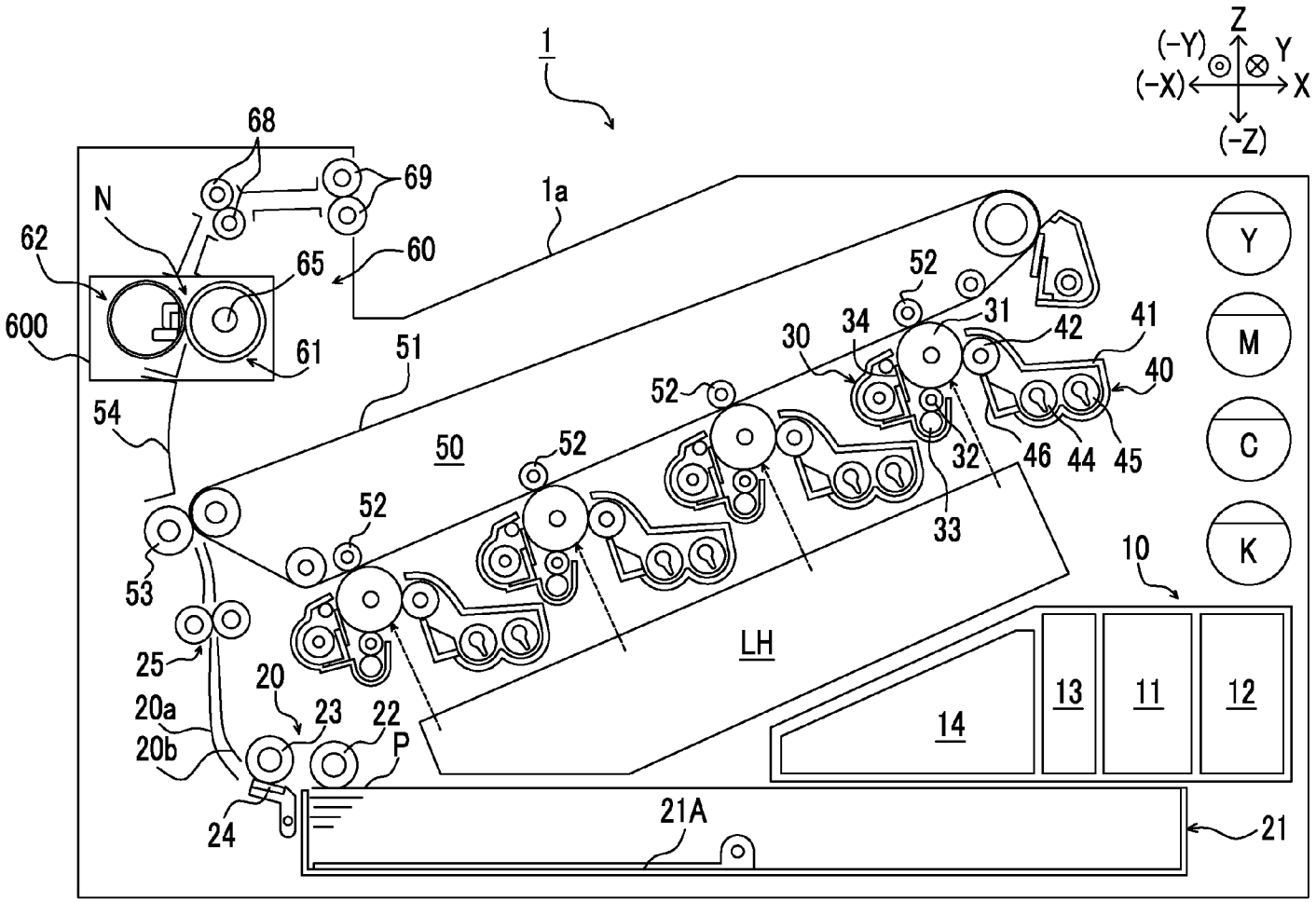
FIG. 1 is a vertical cross sectional view schematically illustrating an internal structure of an image forming apparatus.

With reference to the accompanying drawings, the invention is described in detail together with exemplary embodiments and specific examples, but the invention is not limited to the exemplary embodiments and the specific examples.

Further, in the description with reference to the drawings, the drawings are schematically provided, and it should be understood that ratios of respective dimensions and the like are different from those in reality. For simplicity of the following description, members other than those necessary in the description are appropriately omitted in the figures.

Additionally, for simplicity of the following description, in the drawings, the frontward and rearward directions are defined as the X-axis directions, the right and left directions are defined as the Y-axis directions, and the up and down directions are defined as the Z-axis directions.

(1) Overall Structure and Operation of Image Forming Apparatus

FIG. 1 is a cross sectional view schematically illustrating an internal structure of an image forming apparatus 1 according to the present exemplary embodiment.

Hereinafter, the overall structure and the operation of the image forming apparatus 1 is described with reference to FIG. 1.

(1.1) System Structure of Image Forming Apparatus

The image forming apparatus 1 includes a control device 10, a paper feeding device 20, a photoconductor unit 30, a developing device 40, a transfer device 50, and a fixing device 60. An exit tray 1*a* from which a paper P exits and in which the paper P is collected is formed on the upper surface (Z direction) of the image forming apparatus 1. Here, the paper P is an example of a sheet on which an image is recorded.

The control device 10 includes an image forming apparatus control section 11 that controls the operation of the image forming apparatus 1, a controller section 12 that prepares image data according to the print processing request, an exposure control section 13 that controls lighting of an exposure device LH, a power supply device 14, and the like. The power supply device 14 applies voltage to a charging roller 32, a developing roller 42, primary transfer rollers 52, a secondary transfer roller 53, and the like to be described below, and also supplies electric power to the exposure device LH.

The controller section 12 converts printed information input from an external information transmitting apparatus (for example, a personal computer) into image information for forming a latent image, and outputs a driving signal to the exposure device LH at a predetermined timing.

(1.2) Configuration and Operation of Image Forming Section

The paper feeding device 20 is provided on the lower section of the image forming apparatus 1. The paper feeding device 20 includes a paper cassette 21 as an example of a sheet collecting section in which the paper P as a bundle of sheets is loaded on the upper surface of the paper cassette 21. After the paper of which the position in a width direction is determined by a regulating plate (not illustrated) is extracted forward (−X direction) by a nudger roller 22 from the upper side, one sheet by one, the paper is introduced between a feeding roller 23 as an example of a transporting unit and a retard pad 24 as an example of a detaching member so that an upper surface of the paper P comes into contact with the feeding roller 23, and the paper P is transported to a contact member of a registration roller pair 25.

The photoconductor unit 30 includes photoconductor drums 31 as image holding bodies that are provided respectively in parallel on the upper side of the paper feeding device 20 (Z direction) and driven to rotate. According to the rotation direction of the photoconductor drums 31, the charging roller 32, the exposure device LH, the developing device 40, the primary transfer rollers 52, and a cleaning blade 34 are arranged. A cleaning roller 33 that cleans the front surface of the charging roller 32 is arranged on the charging roller 32 to face and come into contact with the charging roller 32.

The developing device 40 includes a developing housing 41 in which a developer is collected. In the developing housing 41, the developing roller 42 arranged to face the photoconductor drum 31 and a pair of augers 44 and 45 that stir the developer and transport the developer to the developing roller 42 side are arranged on the diagonally lower side on the back surface of the developing roller 42. On the developing roller 42, a layer regulating member 46 that regulates the film thickness of the developer is closely arranged.

The respective developing devices 40 are formed in the same manner except the developers collected in the developing housings 41 to form toner images of yellow (Y), magenta (M), cyan (C), and black (K).

The front surface of the rotating photoconductor drum 31 is charged by the charging roller 32, and an electrostatic latent image is formed by latent image forming light emitted from the exposure device LH. The electrostatic latent image formed on the photoconductor drum 31 is developed as a toner image by the developing roller 42.

The transfer device 50 includes an intermediate transfer belt 51 on which various color toner images formed on the photoconductor drums 31 of the respective photoconductor units 30 are multi-transferred, and the primary transfer rollers 52 that sequentially transfer (primary transfer) the respective color toner images formed on the respective photoconductor units 30 to the intermediate transfer belt 51. In addition, the transfer device 50 further includes the secondary transfer roller 53 that collectively transfer (secondary transfer) the respective color toner images overlapped and transferred to the intermediate transfer belt 51, to the paper P.

The respective color toner images formed on the photoconductor drums 31 of the respective photoconductor units 30 are subjected to sequential electrostatic transfer (primary transfer) onto the intermediate transfer belt 51 by the primary transfer rollers 52 to which a certain transfer voltage is applied from the power supply device 14 and the like controlled by the image forming apparatus control section 11 so that an overlapped toner image on which respective color toners are overlapped is formed.

The overlapped toner image on the intermediate transfer belt 51 is transported to an area (a secondary transfer section T) in which the secondary transfer roller 53 is arranged according to the movement of the intermediate transfer belt 51. If the overlapped toner image is transported to the secondary transfer section T, the paper P is supplied to the secondary transfer section T from the paper feeding device 20 according to the timing. Also, a given transfer voltage is applied to the secondary transfer roller 53 from the power supply device 14 and the like controlled by the image forming apparatus control section 11 so that a multiplex toner image on the intermediate transfer belt 51 is collectively transferred to the paper P which is fed from the registration roller pair 25 and guided by a transporting guide.

The residual toner on the front surface of the photoconductor drum 31 is removed from the cleaning blade 34, and collected in the waste developer collecting section. The front surface of the photoconductor drum 31 is recharged by the charging roller 32. Additionally, the residue that is not removed by the cleaning blade 34 and that is attached to the charging roller 32 is caught on the front surface of the cleaning roller 33 rotating in contact with the charging roller 32, and accumulated.

The fixing device 60 includes a fixing unit 600, a transporting roller pair 68, and an exit roller pair 69. The fixing unit 600 has a heat module 61 and a pressure module 62, and a fixing nip section N (fixing area) is formed by a press-contact area between the heat module 61 and the pressure module 62.

In the transfer device 50, the paper P to which a toner image is transferred through a transporting guide 54 to the fixing device 60 in a state in which the toner image is unfixed. The toner image is fixed on the paper P transported to the fixing device 60 by an operation of the press-bonding and the heating by the pair of the heat module 61 and the pressure module 62.

The paper P on which the fixed toner image is formed exits through the transporting roller pair 68 from the exit roller pair 69 to the exit tray 1*a* on the upper surface of the image forming apparatus 1.

(2) Configuration and Operation of Paper Feeding Device

Figure 2:
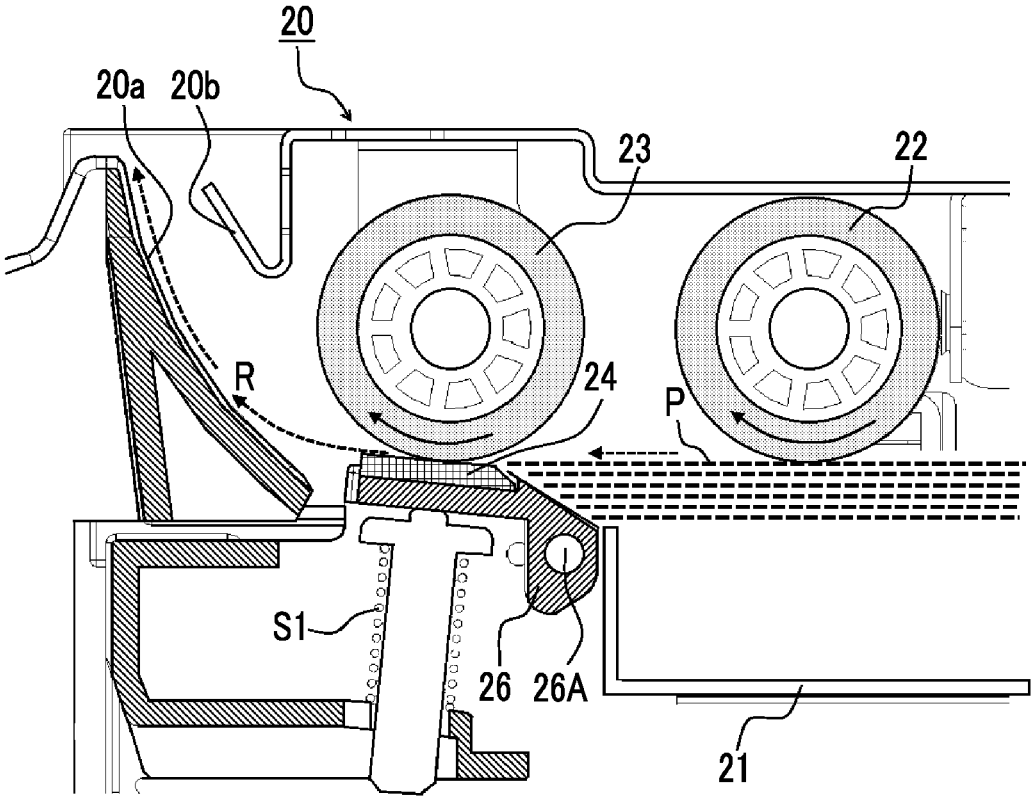
FIG. 2 is a cross-sectional view schematically illustrating an internal configuration of a paper feeding device of the image forming apparatus (except a paper cassette) and paper transportation.
Figure 3:
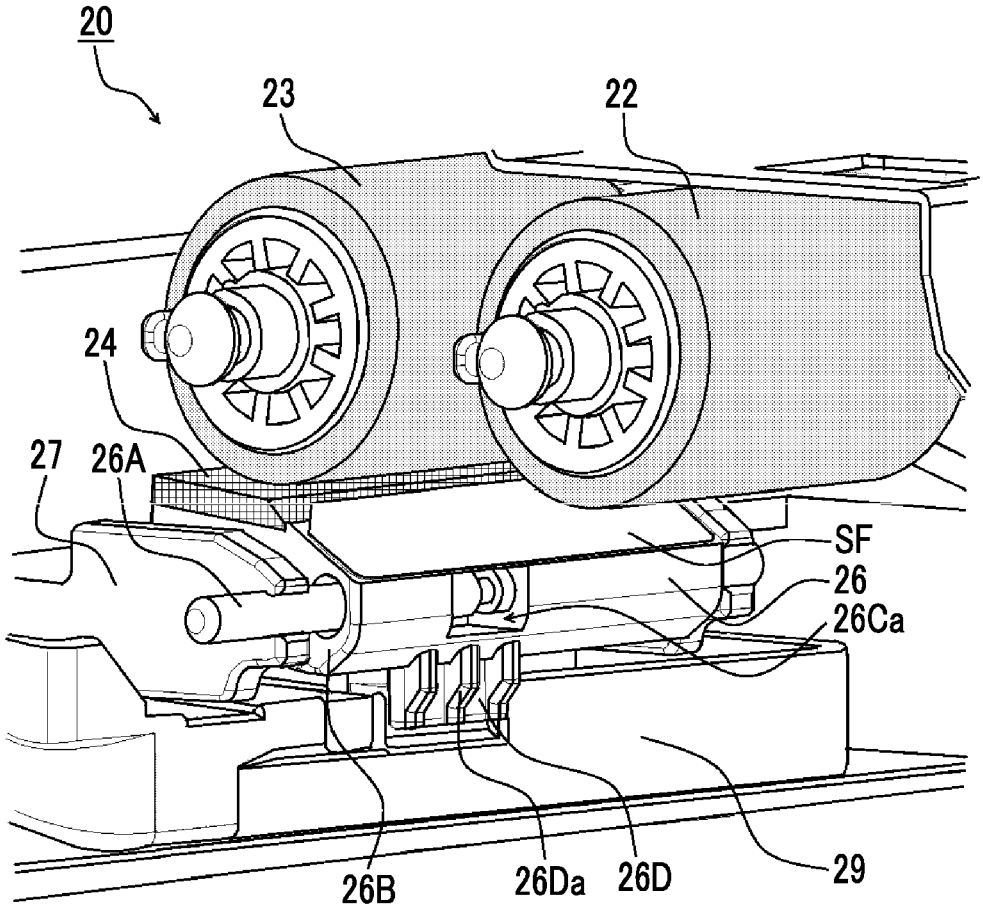
FIG. 3 is a perspective view illustrating a structure of mounting a feeding roller and a retard pad of the paper feeding device.
Figure 4:
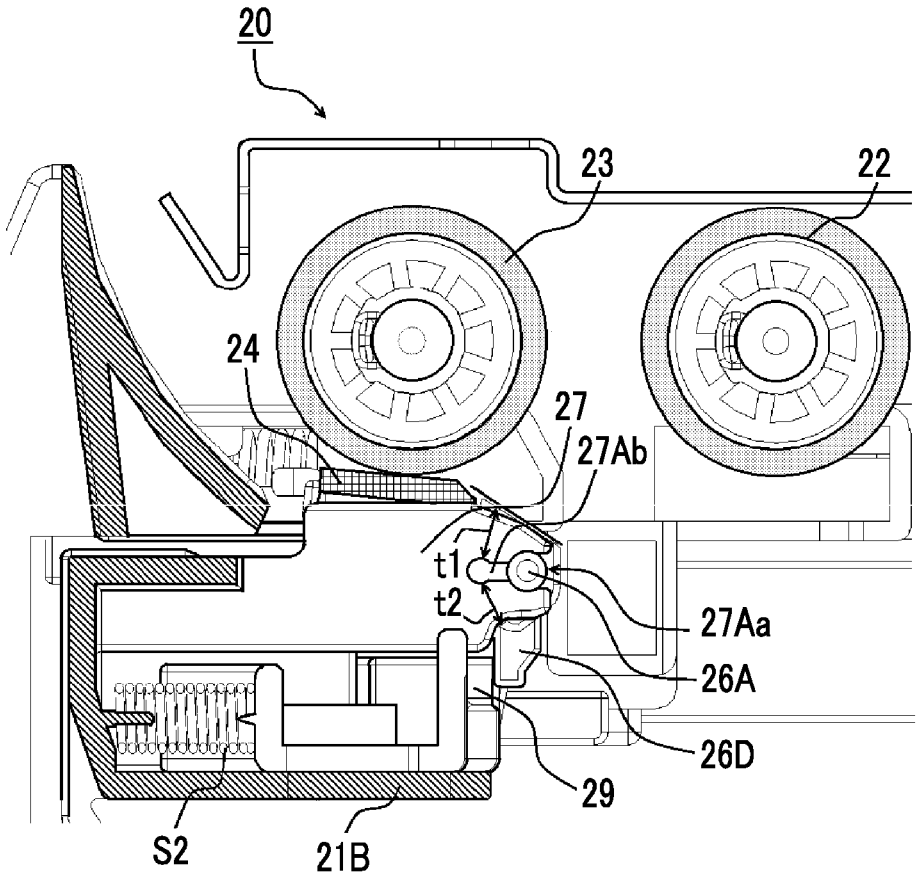
FIG. 4 is a side view illustrating a structure of mounting the feeding roller and the retard pad of the paper feeding device.
Figure 5A:
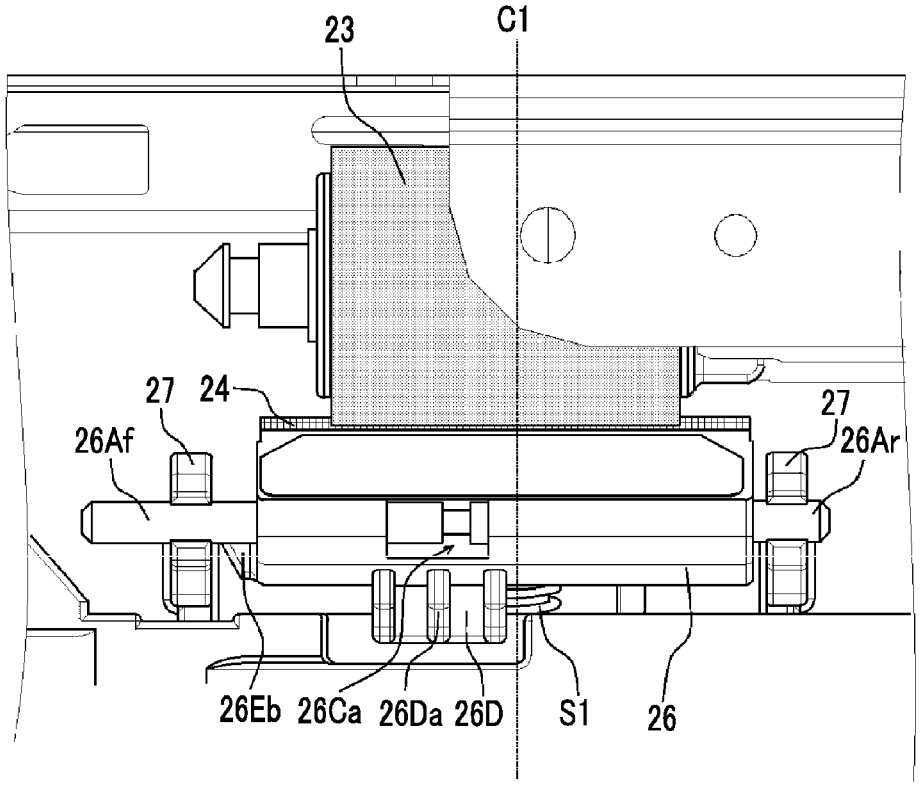
FIG. 5A is a diagram schematically illustrating a structure of supporting the retard pad in a view on an upstream side of the paper transportation.
Figure 5B:
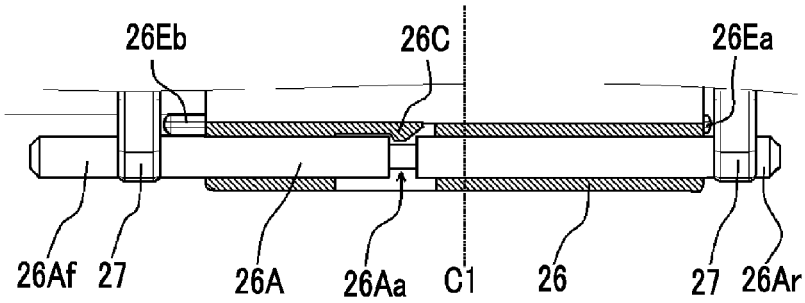
FIG. 5B is a partial cross-sectional view illustrating a fitting state of a rotation shaft to a retard holder, which is an example of the shaft.
Figure 6A:
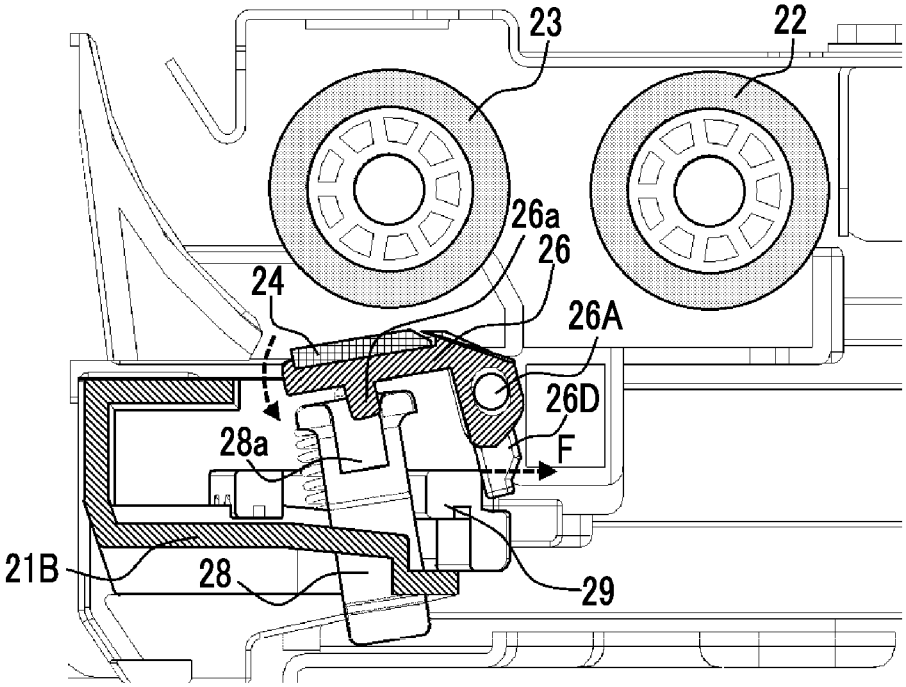
FIG. 6A is a vertical cross-sectional view schematically illustrating a releasing mechanism of the press-contact between the feeding roller and the retard pad.
Figure 6B:
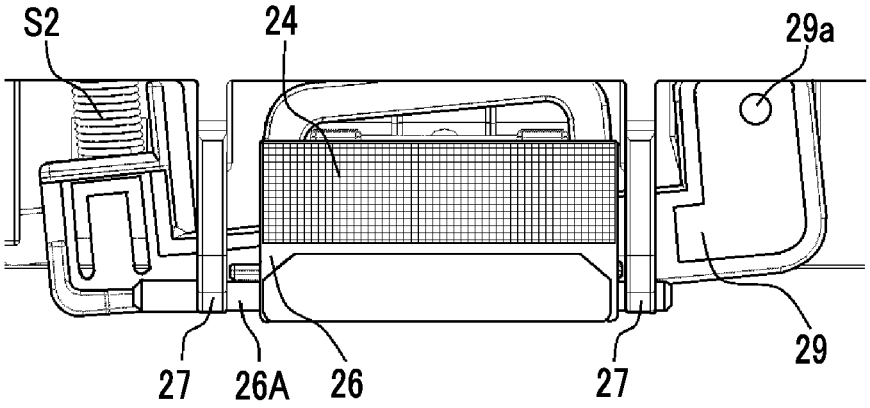
FIG. 6B is a plan view schematically illustrating the releasing mechanism of the press-contact between the feeding roller and the retard pad.
Figure 7:
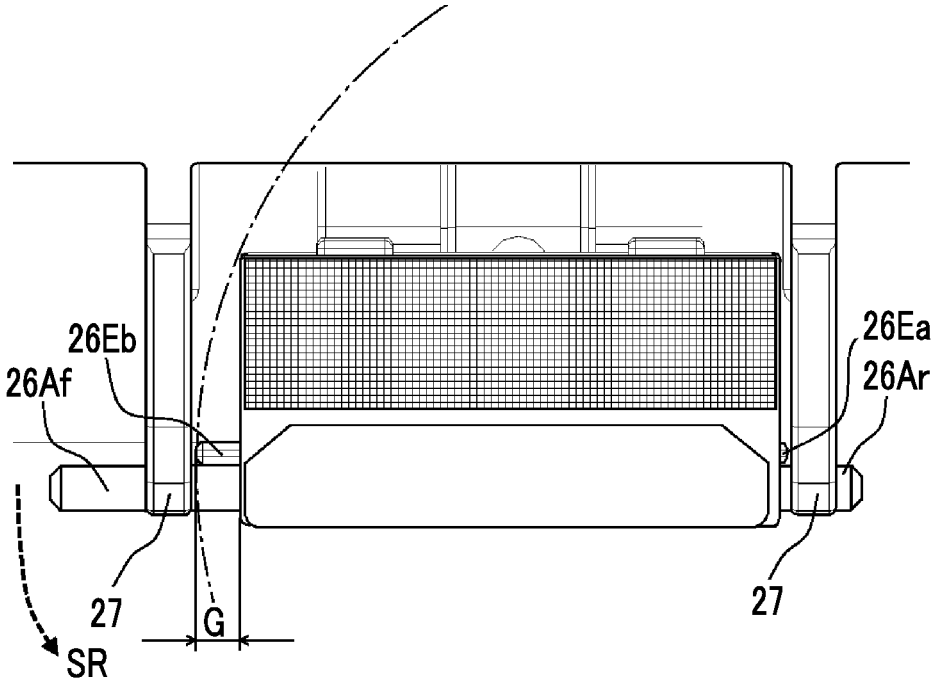
FIG. 7 is a plan view illustrating removal of the retard pad.

FIG. 2 is a vertical cross-sectional view schematically illustrating an internal configuration of the paper feeding device 20 of the image forming apparatus 1 (except the paper cassette 21) and paper transportation according to the present invention, FIG. 3 is a perspective view illustrating a structure of mounting the feeding roller 23 and the retard pad 24 of the paper feeding device 20, FIG. 4 is a side view illustrating a structure of mounting the feeding roller 23 and the retard pad 24 of the paper feeding device 20, FIG. 5A is a diagram schematically illustrating a structure of supporting the retard pad 24 in a view on an upstream side of the paper transportation, FIG. 5B is a partial cross-sectional view illustrating a fitting state of a rotation shaft 26A to a retard holder 26, which is an example of the shaft according to the present exemplary embodiment, FIG. 6A is a vertical cross-sectional view schematically illustrating a releasing mechanism of the press-contact between the feeding roller 23 and the retard pad 24, FIG. 6B is a plan view schematically illustrating the releasing mechanism of the press-contact between the feeding roller 23 and the retard pad 24, and FIG. 7 is a plan view illustrating removal of the retard pad 24.

Hereinafter, the configuration and the operation of the paper feeding device 20 of the image forming apparatus 1 are described with reference to the drawings.

(2.1) Configuration and the Paper Transportation of Paper Feeding Device

The paper feeding device 20 includes the paper cassette 21 disposed on the lower portion of the main body of the image forming apparatus 1 (see FIG. 1). The nudger roller 22 that is in contact with the distal end side of the upper surface of the paper P and feeds the paper P from the paper cassette 21 is provided right above the distal end side (−X direction in FIGS. 1 and 2) of the paper cassette 21.

As illustrated in FIG. 2, a paper loading plate 21A (illustrated in FIG. 1) in which the paper P is loaded in a bundle form is provided on the paper cassette 21. In the paper loading plate 21A, the uppermost sheet of paper P among sheets of the paper P which are biased to the upper side by a spring member (not illustrated) and are loaded in the paper loading plate 21A comes in contact with the nudger roller 22.

As a result, even if the loaded sheet of paper P is fed by the nudger roller 22, and the number of sheets of paper P decreases, the spring member biases the paper loading plate 21A to the upper side so that the uppermost sheet of paper P comes into contact with the nudger roller 22.

On the downstream side of the nudger roller 22 in the paper transportation direction, the feeding roller 23 is provided as an example of a transporting unit. On the lower side of the feeding roller 23, the retard pad 24 as the detaching member is arranged to face the feeding roller 23.

Accordingly, a nip portion that interposes the paper P fed from the paper cassette 21 is formed between the feeding roller 23 and the retard pad 24.

The feeding roller 23 is a driving roller that is rotationally-driven about a shaft with a direction perpendicular to the paper transportation direction as an axial direction, by a driving portion (not illustrated) provided in the main body of the image forming apparatus 1.

The feeding roller 23 comes into contact with the upper surface (front surface) of the paper P which is fed from the paper cassette 21 and transported to the nip portion, and is rotationally driven to transport the paper P to the downstream.

The retard pad 24 is a friction member that swings around a shaft with a direction perpendicular to the paper transportation direction as the axial direction, and comes into contact with the feeding roller 23, and is supported by the retard holder 26 as a supporting member.

The retard holder 26 has the rotation shaft 26A on the upstream side in the paper transportation direction, is supported by a compression spring S as a biasing unit with the rotation shaft 26A as a center in an swingable manner, so that the retard pad 24 may be moved in a direction of coming close to or moving away from the feeding roller 23.

Therefore, if the paper P comes into contact with the front surface of the retard pad 24, and the pressure contact force is applied to the retard pad 24 by a compression spring S1 owing to the friction with the paper P, the retard pad 24 functions as a brake that generates a certain sliding load, and if the sliding load equal to or greater than a certain force is applied to the retard pad 24, the retard pad 24 may be moved in a direction of moving away from the feeding roller 23.

Additionally, if the transported paper P is cardboard or the like, the required load is great, so the rotation shaft 26A is supported on two sides at portions corresponding to both sides of the retard pad 24 according to the present exemplary embodiment, but if the load is small, the rotation shaft 26A may be changed to be supported on one side.

In this manner, since the retard pad 24 functions as a brake, if the plural sheets of paper P are transported to the nip portion in an overlapped manner, transportation resistance is applied from the lower surface side (backside) to the paper P so that the multiple transportation of the paper P transported by the feeding roller 23 is suppressed.

That is, the feeding roller 23 and the retard pad 24 are paired, and detach (manage) the overlapped sheets of paper P so that the paper P is fed per one sheet (see an arrow R in FIG. 2).

Guide chutes 20*a* and 20*b* that guide the paper P to the registration roller pair 25 are provided between the registration roller pair 25 (illustrated in FIG. 1) and the feeding roller 23 arranged on the downstream side of the feeding roller 23 in the paper transportation direction.

If the detachment and the transportation of the paper P fed from the nudger roller 22 is continued by the feeding roller 23 and the retard pad 24 configured as described above, it is concerned that the front surface of the retard pad 24 is worn, and the detachment performance of the paper P decreases.

Therefore, when a predetermined feeding number of sheets of paper P is detached and transported, the used retard pad 24 is removed and changed to the new retard pad 24.

(2.2) Configuration of Attaching and Removing Retard Pad from Paper Feeding Device As illustrated in FIGS. 3 and 4, a pair of holding sections 27 which is an example of a holding section according to the present exemplary embodiment for detachably holding the retard holder 26 in a central section on the front end side (paper feeding side) of the paper cassette 21 is provided in the paper feeding device 20 according to the present exemplary embodiment.

The holding sections 27 each includes a bearing section 27*a* open on the paper cassette 21 side, both end portions of the rotation shaft 26A of the retard holder 26 are fit to the bearing sections 27*a* by snap-fit.

The retard pad 24 is arranged to come into contact with one surface side of the retard holder 26 with the front surface exposed, and a guide sheet SF that guides the fed paper P to the press-contact portion between the feeding roller 23 and the retard pad 24 comes into contact with on the upstream side of the retard pad 24 in the paper transportation direction.

Also, the rotation shaft 26A is fit into one end side of the retard holder 26, and the retard pad 24 and the retard holder 26 are collectively held by the holding sections 27, so the retard pad 24 and the retard holder 26 configure a detaching member unit which is collectively handled.

A pushing member 28 that presses to push up the retard holder 26 in the direction perpendicular to the paper transportation direction by the compression spring S1 which is an example of the biasing unit is movably arranged on a central portion lower surface 21B on the front end side of the paper cassette 21.

In the pushing member 28, a concave section 28*a* is formed on the distal end side so that a convex section 26*a* formed on the backside of the surface on which the retard pad 24 of the retard holder 26 is bonded is fit into the pushing member 28.

Also, in the pushing member 28, the retard holder 26 that is pressed from the backside of the surface on which the retard pad 24 is bonded swings about the rotation shaft 26A, and the retard pad 24 is subjected to the press-contact onto the feeding roller 23.

As illustrated in FIG. 5A, a supporting point hole 26Ba through which the rotation shaft 26A is inserted is formed on a rotation support section 26B of the retard holder 26 to penetrate the rotation support section 26B in a direction perpendicular to the swinging direction. Further, a snap fit portion 26C is formed at a position biased from a central line c1 in the paper transportation direction of the retard pad 24 to the side on which the paper cassette 21 is detached and attached on the rotation support section 26B in which the supporting point hole 26Ba is formed.

As illustrated in FIG. 5B, a concave section 26Aa is formed in a central section in an axial line direction so that the rotation shaft 26A has a symmetric form with the concave section 26Aa as a center. Also, the rotation shaft 26A is inserted from one end side to penetrate the supporting point hole 26Ba of the retard holder 26 so that the rotation shaft 26A may be maintained to be attached and detached from the snap fit portion 26C.

As a result, even if the rotation shaft 26A is inserted from any one end side and penetrates the supporting point hole 26Ba, the position of the rotation shaft 26A is fixed in a state of protruding a one end side 26Af (side which the paper cassette 21 is attached to and detached from) in the rotation support section 26B of the retard holder 26.

The pair of holding sections 27 each has a bearing section 27A open on the upstream side in the paper transportation direction, and both end portions of the rotation shaft 26A of which position is fixed to the rotation support section 26B of the retard holder 26 in a state of protruding on the one end side (side which the paper cassette 21 is attached to and detached from) are fit into the bearing sections 27A by snap-fit.

In the bearing section 27A, a notch section 27Ab is formed on a side facing an opening section 27Aa open to the upstream side in the paper transportation direction, and the resistance generated when the both end portions of the rotation shaft 26A are attached or detached is suppressed (see FIG. 4).

Further, in the bearing section 27A, with respect to the notch section 27Ab, a thickness t1 on the upper side illustrated in FIG. 4 is formed to be thicker than a thickness t2 on the lower side with respect to the thicknesses of the holding sections 27 which are perpendicular to a direction in which both end portions of the rotation shaft 26A are attached to or detached from by snap-fit. Therefore, even if plastic deformation is generated in the holding sections 27 according to the attachment or detachment of the rotation shaft 26A with respect to the bearing section 27A, the deformation is suppressed from reaching the upper surface that becomes a paper passing surface of the paper P.

As illustrated in FIGS. 6A and 6B, a lever member 29 that swings in a direction perpendicular to the attaching and detaching direction of the paper cassette 21 is arranged on the central portion lower surface 21B on the front end side of the paper cassette 21.

A supporting point section 29A is formed on one side, and the lever member 29 is rotatably supported in a direction perpendicular to the attaching and detaching direction of the paper cassette 21 on the central portion lower surface 21B. The other end side is biased by a compression coil spring S2 to protrude in an attaching and detaching trajectory of the paper cassette 21.

A projecting unit 26D is formed on the other end side of the snap fit portion 26C of the rotation support section 26B of the retard holder 26, and faces the swinging direction of the lever member 29. As a result, when the paper cassette 21 is dragged from the main body of the image forming apparatus 1, the lever member 29 swings to the paper cassette 21 side by the compression coil spring S2 with the supporting point section 29A as a rotation center, comes into contact with the projecting unit 26D of the retard holder 26 (see Fin FIG. 6A), and moves the retard holder 26 to move away from the feeding roller 23 with the rotation shaft 26A as a rotation center, so that the press-contact of the retard pad 24 is released (see FIG. 6A).

Additionally, according to the present exemplary embodiment, the projecting unit 26D is formed to have a stiffening rib 26Da on the lower side of an opening section 26Ca in which the snap fit portion 26C of the rotation support section 26B is formed to reinforce the opening section 26Ca of the rotation support section 26B (see FIG. 5A).

As illustrated in FIG. 7, a first protruding portion 26Ea and a second protruding portion 26Eb that protrude in an axial direction of the rotation shaft 26A and face the inner side surface of the holding sections 27 are formed on the rotation support section 26B of the retard holder 26. When the protruding one end side of the rotation shaft 26A is operated to be moved on the upstream side in the paper transportation direction with the second protruding portion 26Eb on the other end side of the rotation shaft 26A held onto the bearing section 27A of the holding section 27 by snap-fit, as a rotation center, and the snap-fit is released, the second protruding portion 26Eb is formed to protrude to maintain a gap in a scope that causes the extension portion of the retard holder 26 not to come into contact with the inner surface side of the holding section 27.

(2.3) Operation of Attaching and Detaching Retard Pad from the Paper Feeding Device 20

In the paper feeding device 20 configured as described above, the retard pad 24 and the retard holder 26 are integrated, and the protruding one end side 26Af of the rotation shaft 26A may be attached and detached by a movement operation from the attaching and detaching side of the paper cassette 21.

If the paper cassette 21 is dragged from a certain position in the main body of the image forming apparatus 1, the lever member 29 swings to the paper cassette 21 side by the compression coil spring S2 with the supporting point section 29A as a rotation center, comes into contact with the projecting unit 26D of the retard holder 26, and moves the retard holder 26 to move away from the feeding roller 23 with the rotation shaft 26A as a rotation center, so that the press-contact of the retard pad 24 is released.

Therefore, if the paper cassette 21 is dragged while the front end of the paper P or the like is interposed between the retard pad 24 and the feeding roller 23, the mutual pulling of the paper P from the portion of the paper collected in the paper cassette 21 and the interposed portion of the paper is generated, so it is of concern that the paper P may tear or wrinkles may form. However, if the press-contact is released by the lever member 29, the corresponding mutual pulling is hardly generated.

If the press-contact of the retard pad 24 is released, the retard pad 24 is integrated with the retard holder 26 and held on the holding section 27 by snap-fit.

In the corresponding state, the other end side 26Ar of the rotation shaft 26A held on the holding section 27 by snap-fit is set to be the rotation center, and the protruding one end side 26Af of the rotation shaft 26A rotates from the side on which the paper cassette 21 is dragged, to the upstream side in the paper transportation direction (an arrow SR in FIG. 7), and releases the snap-fit on the one end side 26Af of the rotation shaft 26A from the opening section 27Aa in the bearing section 27A of the holding section 27.

The second protruding portion 26Eb is formed on the rotation support section 26B of the retard holder 26 to protrude to maintain a gap G (see FIG. 7) in an extent (illustrated with alternate long and short dashed lines in FIG. 7) in which the extension portion of the retard holder 26 does not come into contact with the inner surface side of the holding section 27. Therefore, the movement operation may be performed while rotating the protruding one end side 26Af of the rotation shaft 26A on the upstream side in the paper transportation direction so that the attaching and detaching operation in the main body of the image forming apparatus 1 may be easily performed.

Additionally, since the entire portion of the retard holder 26 is lowered by the operation of the lever member 29, the locus when the retard holder 26 rotates more easily interferes than in a case when the retard holder 26 is not lowered. However, a protruding portion 26E has a sufficient length so that no interference of the locus occurs even if the retard holder 26 rotates while the retard holder 26 is lowered.

Subsequently, the snap-fit on the other end side 26Ar of the rotation shaft 26A which becomes the rotation center is released from the opening section 27Aa in the bearing section 27A of the holding section 27, and the retard pad 24 and the retard holder 26 are removed in an integrated manner.

When the new retard pad 24 is mounted instead of the removed retard pad 24, the rotation shaft 26A on the other end side of the retard holder 26 on which the retard pad 24 is bonded is firstly mounted on the opening section 27Aa in the bearing section 27A of the holding section 27 by snap-fit.

Subsequently, the other end side 26Ar of the rotation shaft 26A held on the holding section 27 by snap-fit is set to be the rotation center, the protruding one end side 26Af of the rotation shaft 26A rotates from the side on which the paper cassette 21 is dragged, from the upstream side in the paper transportation direction to the downstream side, and is mounted on the opening section 27Aa in the bearing section 27A of the holding section 27 by snap-fit.

Accordingly, when the rotation shaft 26A is attached to or detached from the bearing section 27A of the holding section 27 by snap-fit, since the notch section 27Ab is formed on the side facing the opening section 27Aa, the damage of the bearing section 27A is prevented and the attachment and detachment may be more easily performed.

In the paper feeding device 20 according to the present exemplary embodiment, since the retard pad 24 and the retard holder 26 are detachably mounted to the main body of the image forming apparatus 1 in an integrated manner, compared with the configuration in which the retard pad 24 and the retard holder 26 are not arranged in the main body of the image forming apparatus 1, the paper P maybe precisely aligned and supplied in a direction perpendicular to the paper transportation direction to the image forming section.

Further, when the feeding roller 23 is also arranged in the main body of the image forming apparatus 1 to face the retard pad 24 and the retard holder 26, the paper P may be more precisely aligned and supplied to the image forming section.

(2.4) Modification Example of Detaching Member

Figure 8:
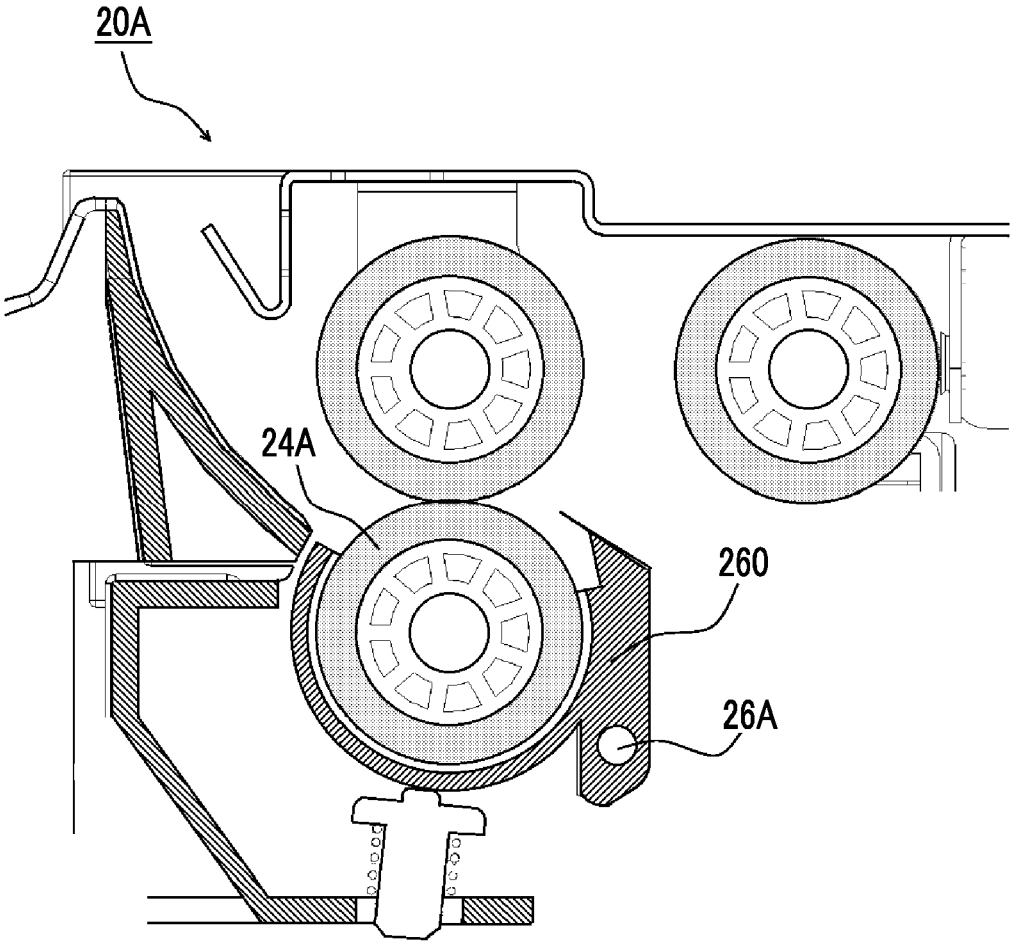
FIG. 8 is a vertical cross-sectional view schematically illustrating an internal configuration of a paper feeding device using a retard roller as another example of the detaching member (except the paper cassette) and the paper transportation.

FIG. 8 is a vertical cross-sectional view schematically illustrating an internal configuration of a paper feeding device 20A using a retard roller 24A as another example of the detaching member (except the paper cassette 21) and the paper transportation.

The retard roller 24A is a driven roller that rotates about a shaft with the direction perpendicular to the paper transportation direction as the axial direction, and the torque limiter (not illustrated) is mounted on the rotation shaft of the retard roller 24A.

Therefore, if the paper P comes into contact with the front surface of the retard roller 24A, and the rotating force is applied to the retard roller 24A owing to the friction with the paper P, the retard roller 24A functions as a brake that generates a certain rotational load, and is also rotationally driven when the rotating force equal to or higher than a certain force is applied to the retard roller 24A.

The retard roller 24A is supported by a retard holder 260 as a supporting member, and the retard roller 24A and the retard holder 260 may be attached or detached by performing the movement operation on the protruding one end side of the rotation shaft 26A from the attaching and detaching side of the paper cassette 21 in an integrated manner.

In the above, exemplary embodiments according to the invention have been described in detail, but the invention is not limited to the exemplary embodiments, and various kinds of modifications are possible without departing from the gist of the invention recited in the accompanying claims.

For example, a paper feeding device that feeds paper to an image forming apparatus is described in the present exemplary embodiment, but the invention may be applied to an image reading device that feeds a document which is an example of a sheet to the document reading device.

Further, as the sheet collecting section, the invention is applied to a paper cassette that is incorporated with the device main body, but the sheet collecting section is not required to be covered, and maybe applied to a portion of which the upper portion is released such as manual feed or document feed.

Since the attaching and detaching operation to the upstream side in the paper transportation direction is easier, and the retard holder 26 also serves as a guide from the paper cassette 21 to the retard pad 24, the rotation shaft 26A is arranged on the upstream side in the paper transportation direction than the retard pad 24 or the feeding roller 23, but the rotation shaft 26A may be arranged on the other position, for example, on the downstream side.

Though it is described that the holding section 27 is held by snap-fit to have an opening to face the upstream in the paper transportation direction, it is also possible to have an opening to face the feeding roller 23 by sufficiently providing a space between the feeding roller 23 and the retard pad 24.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A paper feeding device comprising:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction;

a holding member that holds the shaft from a downstream side so as not to move to the downstream side in the sheet feeding direction, and that releases the shaft from holding when the shaft moves in a direction toward an upstream side in the sheet feeding direction; and a biasing unit that biases the supporting member in a direction of coming close to the transporting unit, wherein the shaft is a rotation shaft on an upstream side or a downstream side from the detaching member in the sheet feeding direction, and is capable of moving the detaching member to come closer to or move away from the transporting unit by being swingably held on the holding member with the rotating shaft as the center, and wherein one end side of the shaft protrudes to an outer side of the holding member further than an other end side.

2. The paper feeding device according claim 1, wherein the holding member supports the shaft on both ends with the detaching member interposed therebetween, and wherein the supporting member includes a second protruding portion longer than a first protruding portion provided on the other end side.

3. An image forming apparatus comprising:

the paper feeding device according to claim 1; and an image forming section that forms an image on a sheet fed by the paper feeding device.

4. An image reading device comprising:

a paper feeding device according to claim 1; and an image reading unit that reads an image of a sheet fed by the paper feeding device.

5. A paper feeding device comprising:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction;

a holding member that holds the shaft not to move to a downstream side in the sheet feeding direction, and that releases the shaft from holding when the shaft moves in a direction other than the sheet feeding direction; and a claw portion that is formed on one end side of the supporting member, and that regulates a movement of a concave section in an axial direction which is formed in a central portion of the shaft in an axial center direction.

6. The paper feeding device according to claim 5, further comprising:

a sheet collecting section that collects the sheets with leaving the transporting unit and the supporting member in a device main body, and that is capable of being dragged from the device main body in the axial direction of the shaft, wherein the holding member supports the shaft on both ends with the detaching member interposed therebetween, and wherein when the sheet collecting section is dragged from the device main body, one end of the shaft is moved to an upstream side in the sheet feeding direction so as to be released from being supported by the holding member.

7. The paper feeding device according to claim 5, wherein the supporting member is provided with an opening section for forming the claw portion that holds the concave section of the shaft, and wherein a projecting unit that overlaps with the opening section, and that projects in a direction intersecting a swinging direction of the lever member, is provided.

8. The paper feeding device according to claim 5, wherein one end side of the shaft protrudes to an outer side of the holding member further than an other end side.

9. The paper feeding device according to claim 5, further comprising:

a sheet collecting section that collects the sheets with leaving the transporting unit and the supporting member in a device main body, and that is capable of being dragged from the device main body in one direction; and a lever member that is provided in the device main body, swings in a direction intersecting a dragging direction of the sheet collecting section, and that moves the supporting member in a direction of moving away from the transporting unit according to an operation of dragging the sheet collecting section.

10. A paper feeding device comprising:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction;

a holding member that holds the shaft from a downstream side so as not to move to the downstream side in the sheet feeding direction, and that releases the shaft from holding when the shaft moves in a direction toward an upstream side in the sheet feeding direction; and a biasing unit that biases the supporting member in a direction of coming close to the transporting unit, wherein the shaft is a rotation shaft on an upstream side or a downstream side from the detaching member in the sheet feeding direction, and is capable of moving the detaching member to come closer to or move away from the transporting unit by being swingably held on the holding member with the rotating shaft as the center, and wherein the paper feeding device further includes a claw portion that is formed on one end side of the supporting member, and that regulates a movement of a concave section in an axial direction which is formed in a central portion of the rotation shaft in an axial center direction.

11. A paper feeding device comprising:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction; and a holding member that holds the shaft not to move to a downstream side in the sheet feeding direction, and that releases the shaft from holding when the shaft moves in a direction other than the sheet feeding direction;

wherein the supporting member includes a first protruding portion that faces an inner side surface of the holding member, and that protrudes in an axial center direction of the shaft, and wherein the supporting member rotates with the first protruding portion as a fulcrum, when the shaft moves to an upstream side in the sheet feeding direction.

12. The paper feeding device according to claim 11, further comprising:

a claw portion that is formed on one end side of the supporting member, and that regulates a movement of a concave section in an axial direction which is formed in a central portion of the shaft in an axial center direction.

13. The paper feeding device according to claim 11, wherein one end side of the shaft protrudes to an outer side of the holding member further than an other end side.

14. The paper feeding device according to claim 11, further comprising:

a sheet collecting section that collects the sheets with leaving the supporting member in a device main body, and that is capable of being dragged from the device main body in the axial direction of the shaft, wherein the holding member supports the shaft on both ends with the detaching member interposed therebetween, and wherein when the sheet collecting section is dragged from the device main body, one end of the shaft is moved to the upstream side in the sheet feeding direction so as to be released from being supported by the holding member.

15. The paper feeding device according to claim 11, further comprising:

a sheet collecting section that collects the sheets with leaving the transporting unit and the supporting member in a device main body, and that is capable of being dragged from the device main body in one direction; and a lever member that is provided in the device main body, swings in a direction intersecting a dragging direction of the sheet collecting section, and that moves the supporting member in a direction of moving away from the transporting unit according to an operation of dragging the sheet collecting section.

16. A paper feeding device comprising:

a transporting unit that feeds one sheet away from sheets;

a detaching member that detaches the one sheet away from the sheets together with the transporting unit:

a supporting member that supports the detaching member, and that includes a shaft longer than the detaching member in a direction perpendicular to a sheet feeding direction;

a holding member that holds the shaft from a downstream side so as not to move to the downstream side in the sheet feeding direction, and that releases the shaft from holding when the shaft moves in a direction toward an upstream side in the sheet feeding direction; and a biasing unit that biases the supporting member in a direction of coming close to the transporting unit, wherein the shaft is a rotation shaft on an upstream side or a downstream side from the detaching member in the sheet feeding direction, and is capable of moving the detaching member to come closer to or move away from the transporting unit by being swingably held on the holding member with the rotating shaft as the center, wherein the paper feeding device further comprises a sheet collecting section that collects the sheets with leaving the supporting member in a device main body, and that is capable of being dragged from the device main body in the axial direction of the shaft, wherein the holding member supports the shaft on both ends with the detaching member interposed therebetween, and wherein when the sheet collecting section is dragged from the device main body, one end of the shaft is moved to the upstream side in the sheet feeding direction so as to be released from being supported by the holding member.

17. The paper feeding device according claim 16, wherein one end side of the shaft protrudes to an outer side of the holding member further than an other end side.

18. A paper feeding device comprising:

a transporting unit that feeds one sheet away from sheets;

a detaching member that detaches the one sheet away from the sheets together with the transporting unit;

a supporting member that supports the detaching member, and that includes a shaft longer than the detaching member in a direction perpendicular to a sheet feeding direction;

a holding member that holds the shaft from a downstream side so as not to move to the downstream side in the sheet feeding direction, and that releases the shaft from holding when the shaft moves in a direction toward an upstream side in the sheet feeding direction; and a biasing unit that biases the supporting member in a direction of corning close to the transporting unit, wherein the shaft is a rotation shaft on an upstream side or a downstream side from the detaching member in the sheet feeding direction, and is capable of moving the detaching member to come closer to or move away from the transporting unit by being swingably held on the holding member with the rotating shaft as the center, and wherein the paper feeding device further comprises:

a sheet collecting section that collects the sheets with leaving the transporting unit and the supporting member in a device main body, and that is capable of being dragged from the device main body in one direction; and a lever member that is provided in the device main body, swings in a direction intersecting a dragging direction of the sheet collecting section, and that moves the supporting member in a direction of moving away from the transporting unit according to an operation of dragging the sheet collecting section.

* * * * *